United States Patent [19]

Tsuji et al.

[11] Patent Number: 4,944,695

[45] Date of Patent: Jul. 31, 1990

[54] CONNECTOR TERMINAL RETAINING CONSTRUCTION

[75] Inventors: Masanori Tsuji; Yoshihiro Murakami; Makoto Yamanashi, all of Shizuoka, Japan

[73] Assignee: Yazaki Corporation, Tokyo, Japan

[21] Appl. No.: 433,101

[22] Filed: Nov. 8, 1989

[30] Foreign Application Priority Data

Dec. 9, 1988 [JP] Japan ..... 63-310115

[51] Int. Cl.[5] ..... H01R 13/40

[52] U.S. Cl. ..... 439/595; 439/598; 439/594

[58] Field of Search ..... 439/594, 595, 598, 603

[56] References Cited

U.S. PATENT DOCUMENTS 3,686,619 8/1972 McCardell et al. ..... 339/59 M 4,565,416 1/1986 Rudy et al. ..... 439/595

4,602,837 7/1986 Sian et al. ..... 439/594

4,714,437 12/1987 Dyki ..... 439/595

4,820,198 4/1989 Lulko et al. ..... 439/595

4,826,452 5/1989 Sian et al. ..... 439/595

*Primary Examiner*—P. Austin Bradley

*Attorney, Agent, or Firm*—Armstrong, Nikaido, Marmelstein, Kubovcik & Murray

[57] ABSTRACT

The present invention is structured for preventing a spacer from being dislocated as inserting a terminal to a terminal compartment provided in a terminal connector housing, so that simple and reliable assembly and connection of the connector are made possible, and incomplete insertion of the terminal can be detected at the same time. This in turn improves the efficiency of the work, reduces the load of a worker and also improves the quality of the connector.

4 Claims, 5 Drawing Sheets

CONNECTOR TERMINAL RETAINING CONSTRUCTION

BACKGROUND OF THE INVENTION

1. Field of the Invention

The present invention relates to a terminal retaining construction in electrical connectors, in which a provisional locking mechanism is provided to a spacer to make the terminal connection reliable and simple and in which the spacer makes it possible to detect incomplete terminal insertion.

2. Description of the Prior Art

FIG. 8 is a vertical cross section of a connector showing a conventional terminal retaining construction. In terminal compartments 28, 28' of the connector housings 27, 27', there are terminal locking steps 29, 29' formed on one side wall, and the other side wall thereof facing the first side wall in the terminal compartments 28, 28', flexible arms 30, 30' are projected inwardly of the terminal compartments 28, 28'.

Because the terminal retaining construction shown in the figure is for the two-pole terminal, the arms 30, 30' are shaped almost like a letter U. Spacers 32, 32' having their front end formed like a wedge snugly fit into the U-shaped inner walls 31, 31' of the arms 30, 30'.

After the termnals 33, 33' are engaged with the steps 29, 29', the spacers 32, 32' are inserted. Then, when the male and female connector housings 27, 27' are joined together, the spacers 32, 32' are pressed against each other and pushed deep into the U-shaped inner walls 31, 31' of the arms 30, 30'. As a result, the terminals 33, 33' are pressed by the arms 30, 30', with a strong force so that the terminals are prevented from being dislocated or released.

The above conventional terminal retaining construction, however, has drawbacks. That is, when the connectors 27, 27' are to be joined together, the spacers 32, 32' will easily be dislocated and there is a good chance of the connectors being joined without the spacers 32, 32' in position.

It is therefore necessary to take precautionary steps to prevent inadvertent dislocation of the spacers 32, 32', and this in turn makes the assembly procedure complicated.

Another drawback is that when the terminals 33, 33' fail to be inserted completely into the terminal compartments 28, 28' (and fail to be engaged with the steps 29, 29'), the spacers 32, 32' cannot apply the locking force to the terminals, so that when wires 34, 34' are pulled, the terminals 33, 33' will slip off from the terminal compartments 28, 28'.

SUMMARY OF THE INVENTION

With a view to overcoming the above drawbacks, the present invention provides a connector terminal retaining construction which, when the connectors are being assembled and joined together, prevents the spacers from being dislocated and thereby ensures a reliable connection with a simple procedure and which prevents imperfect insertion of the terminals.

To achieve the above objective, a connector terminal retaining construction according to the present invention comprises: a terminal-retaining flexible arm provided in a terminal compartment of the connector housing, the arm being adapted to be pressed against a terminal; a spacer for pressing the terminal-retaining flexible arm against the terminal, the spacer being adapted to be inserted into the connector housing in a direction opposite to the terminal insertion direction; a provisional locking projection and a final locking projection, both formed either on one of a wall portion of the terminal compartment or on a spacer; and engagement portions formed on the other member-the wall portion or the space-for engaging with the provisional locking projection and the final locking projection respectively.

The connector terminal retaining construction is also characterized in that the terminal is formed with projections and the spacer is formed with abutting portions which abut against the projections of the terminal when the terminal is not completely engaged with a locking step.

Since the terminal can be inserted into the terminal compartment with the spacer already in a provisionally locked state, the spacer is prevented from coming off the connector, making the terminal locking operation quite easy.

When the termnal is not completely inserted (i.e., when it is not engaged with the terminal locking step), if the spacer is further inserted for its final locking operation, the abutting portions thereof abut against the projections of the terminal, pushing the terminal out of the terminal compartment. Therefore, the incomplete insertion of the terminal can easily be found.

The above and other objects, features and advantages of the invention will become apparent from the following description and the appended claims, taken in conjunction with the accompanying drawings which show a preferred embodiment of the invention by way of example.

DETAILED DESCRIPTION OF THE PREFERRED EMBODIMENTS

Figure 1:
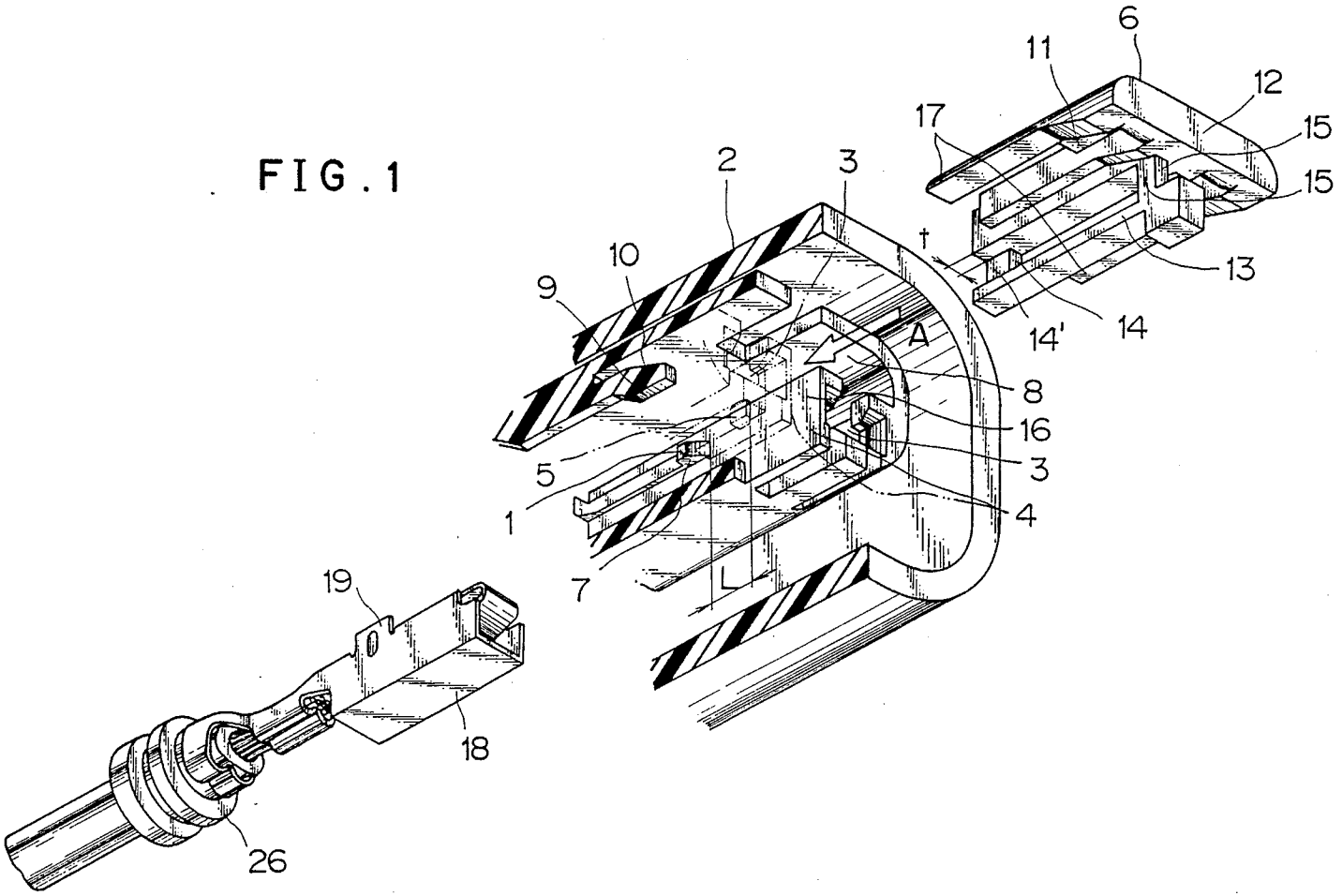
FIG. 1 is an exploded, cutaway perspective view of the connector terminal retaining construction of the present invention.

FIG. 1 is a perspective view of the terminal retaining construction of the connector according to the present invention.

In the figure, reference numeral 1 represents a provisional locking projection formed on the outer surface of a side wall 4, which constitutes the terminal compartment 3 of the connector housing 2. Denoted 5 is a final locking projection. These two projections 1, 5 have inclined surfaces 7 that are inclined with respect to the direction A in which a spacer 6 described hereinafter is inserted. The two projections 1, 5 are located with an appropriate distance L therebetween.

The spacer 6 is formed of synthetic resin material. It is structured such that an upper wall portion 12 of the spacer 6 is inserted into the upper wall portion of the terminal compartment 3 and that a frame portion 13 of the spacer 6 is inserted into a center guide portion 16 of the compartment 3. In more detail, the spacer 6 has pressing wall portions 11 formed near one end of the upper wall portion 12 so that the pressing wall portions 11 engage with the inner surfaces 10 of the terminal retaining flexible arms 9 formed on the upper wall of the terminal compartment 3. The spacer 6 also has the frame portion 13 vertically projecting from the upper wall portion 12. A front pillar 14 of the frame portion 13 is engaged with the provisional locking projection 1 and a rear pillar 15 is engaged with the final locking projection 5. These two engagement pillars 14, 15 are formed resilient to facilitate the engagement with the corresponding locking projections 1, 5. The two pillars 14, 15 are recessed to one-half the thickness (t) of the frame portion 13 on the side 14', 15' opposite to the locking projection engaging side so that the engagement pillar 14 for the provisional locking projection 1 will not interfere with the final locking projection 5 which is located near the inlet of the center guide portion 16 of the connector housing 2.

The spacer 6 also has abutting portions 17 integrally formed therewith on the side of the pressing wall portions 11 in such a way that they project longitudinally.

The abutting portions 17 are set in such a manner that when a hollow square cylinder female terminal 18 fails to engage with a locking step (shown at 20 of FIG. 3) provided inside the terminal compartment 3 (incomplete insertion), the abutting portions 17 abut against projections 19 of the female terminal 18. The projections 19 are formed by cutting the upper wall of the female terminal 18 and erecting the cut portions along the sdie walls. (The projections 19 also serve as a rotation prevention guide during the terminal insertion.)

Figure 2:
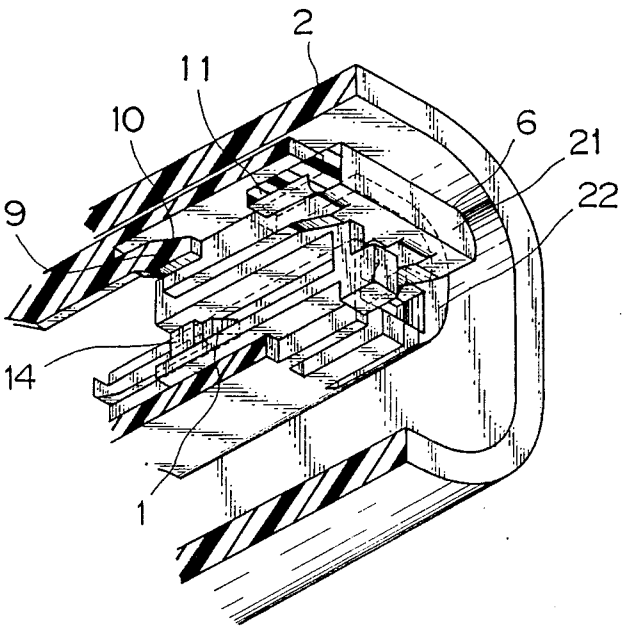
FIG. 2 is a cutaway perspective view of the connector showing the spacer in a provisionally locked condition.
Figure 4:
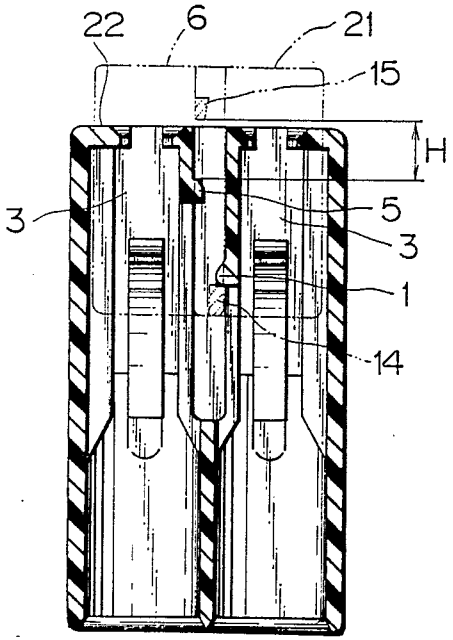
FIG. 4 is a lateral cross section of an essential part of the connector showing the spacer in the provisionally locked condition.
Figure 8:
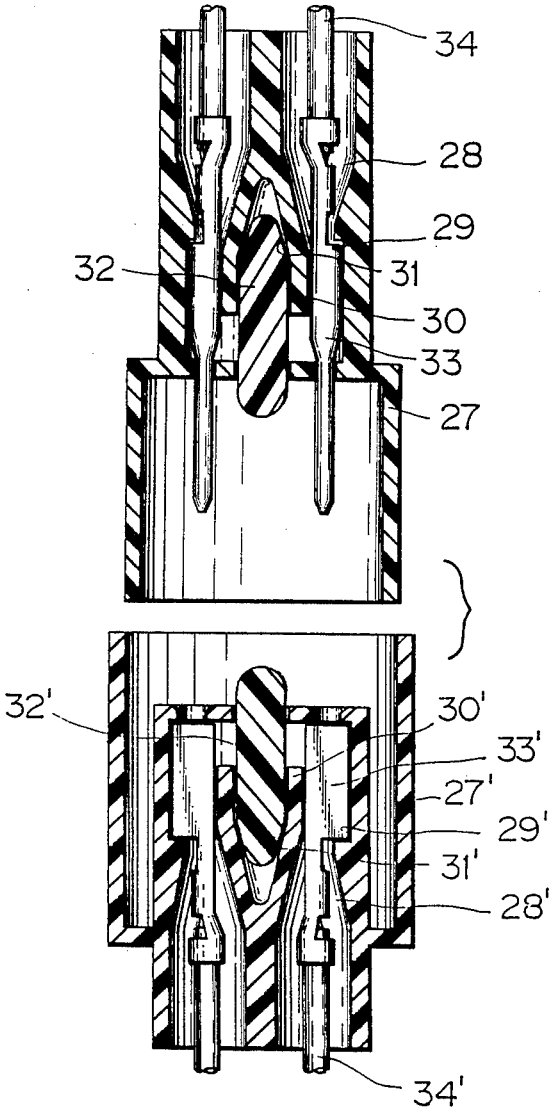
FIG. 8 PRIOR ART
FIG. 8 is a vertical cross section of a conventional connector terminal retaining construction.

FIG. 2 is a perspective view showing the spacer 6 in a provisional locking position. FIG. 4 is a lateral cross section showing the essential portions of FIG. 2.

When the engagement portion 14 (front pillar) of the spacer 6 for the provisional locking operation rides and passes the provisional locking projection 1 of the connector housing 2, the spacer connects to the connector housing 2 in such a manner that it can be freely moved in the range of distance H (FIG. 4). The free end 21 of the spacer 6, even when the spacer 6 is in its innermost position of the free movement range, is nearly flush with the outer wall end 22 of the terminal compartment 3 of the connector housing 2, so that the spacer 6 will not inadvertently be pushed from outside and get fully locked.

Figure 3:
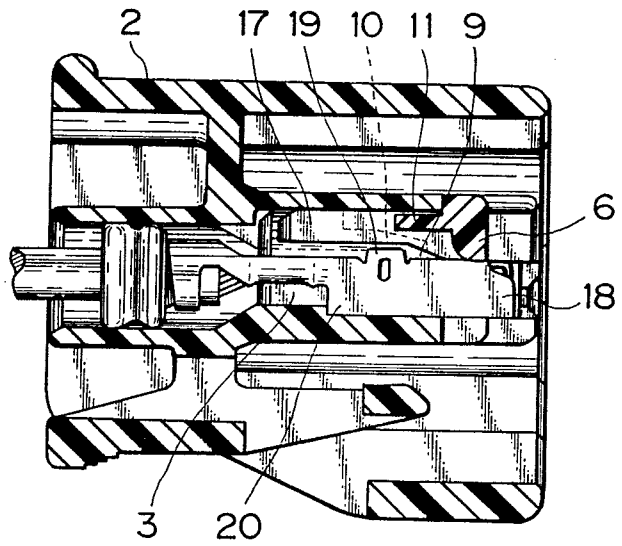
FIG. 3 is a vertical cross section of the connector showing the spacer in a fully locked condition.
Figure 5:
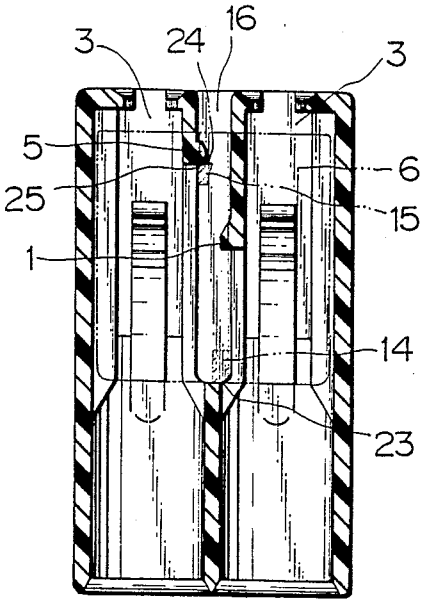
FIG. 5 is a lateral cross section of an essential part of the connector showing the spacer in the fully locked condition.

FIG. 3 is a vertical cross section showing the spacer 6 fully locked. FIG. 5 is a lateral cross section of FIG. 3 showing only the essential parts.

In FIG. 3, with the termnal 18 engaged with the locking step 20 in the terminal compartment 3, when the spacer 6 is pushed into the connector housing 2 by a push tool not shown, the pressing wall portion 11 of the spacer 6 engages with the inner surface 10 of the terminal retaining flexible arm 9, pressing the arm 9 against the terminal 18 to hold the terminal 18 immovable. (During the process of terminal insertion, the projections 19 of the terminal 18 push the abutting portions 17 of the spacer 6, moving the spacer 6 with it in the terminal insertion direction within the spacer free movement range.)

In this condition, the engagement portion 15 (rear pillar) of the spacer 6 for the final locking operation rides and passes the final locking projection 5 located near the inlet of the center guide portion 16 of the connector housing 2, as shown in FIG. 5. At the same time, the front pillar 14 abuts against the end 23 of the center guide portion 16, so that the rear surface 24 of the rear pillar 15 engages with a vertical surface 25 of the final locking projection 5, thus fully locking the spacer.

Next, we will explain about the means to detect an incomplete terminal insertion in the terminal retaining construction according to the present invention.

Figure 6:
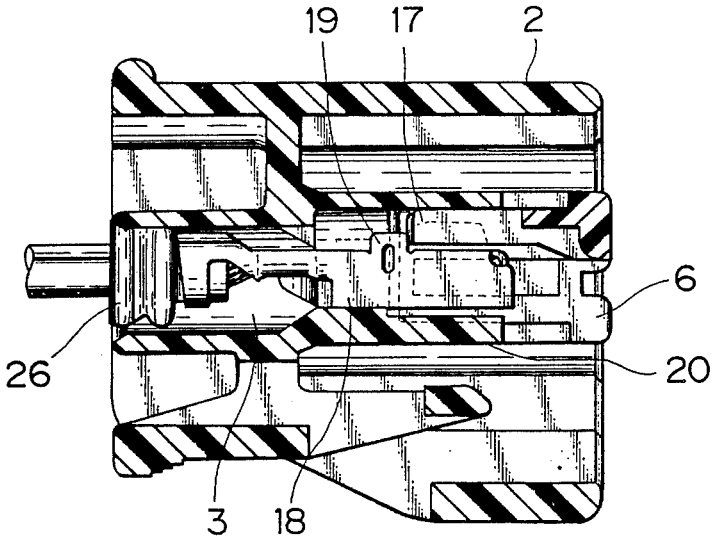
FIG. 6 and 7 are vertical cross sections of the connector terminal retaining construction showing the action of the incomplete terminal insertion detection mechanism of the present invention.
Figure 7:
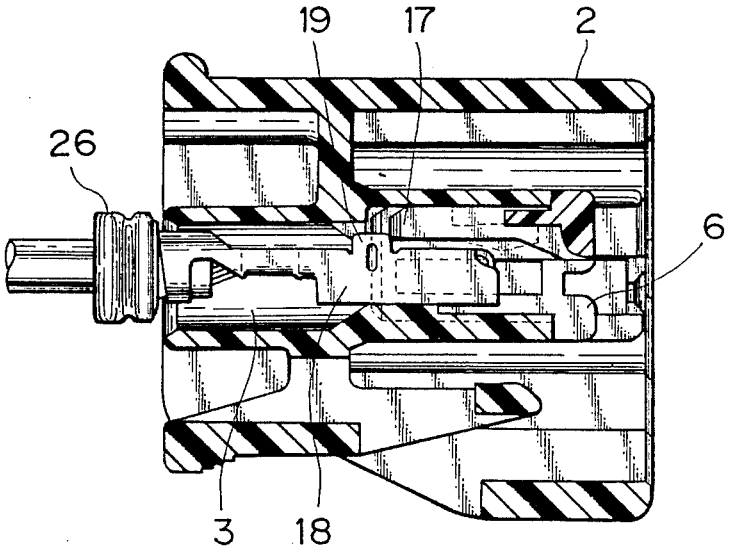

FIG. 6 shows the terminal 18 not completely inserted. The terminal 18 is not engaged with the locking step 20 in the terminal compartment 3 and is thus located higher than the normal position (FIG. 3) in the compartment 3. At the spacer 6 is inserted, the abutting portions 17 of the spacer 6 abut against the projections 19 of the terminal 18, pushing the terminal 18 out of the terminal compartment 3 as shown in FIG. 7. Therefore, a worker can easily find a dislocated rubber plug 26 and know that the terminal is not completely inserted. This prevents the incomplete insertion of the terminal from carrying on undetected.

What is claimed is:

1. A terminal connector retaining construction comprising:

a connector housing, a plural number of terminal compartments provided in said connector housing, a resilient arm and a locking step provided in inner walls of each of said compartment for retaining an inserted terminal, said resilient arm and said locking step being adapted respectively to be pressed against one side of said terminal and to be engaged with the other side of said terminal, a spacer for pressing sid resilient arm against said terminal, said spacer being adapted to be inserted into said connector housing in the direction opposite to a terminal insertion direction, a provisional locking projection and a final locking projection provided on one of the outer wall of said terminal compartment and on said spacer, and engagement portions formed on one of the other member of said wall portion and of said spacer for engaging with said provisional locking projection and said final locking projection respectively.

2. A connector terminal retaining construction as claimed in claim 1, wherein said terminal is formed with projections and said spacer is formed with abutting portions which abut against said projections of said terminal when said terminal is not completely engaged with said locking step.

3. A terminal connector retaining construction as claimed in claim 1, wherein said engagement portion to be locked with said provisional projection is constructed in such a manner that said engagement portion does not interfere with said final locking projection when said spacer is inserted.

4. A terminal connector retaining construction as claimed in claim 3, wherein the interval between said provisional and final locking projections are provided in such a manner that even when said spacer is fully inserted into said terminal compartment, there remains still some distance for completing the final locking operation.

* * * * *